US007771812B2

(12) United States Patent
Beu et al.

(10) Patent No.: US 7,771,812 B2
(45) Date of Patent: Aug. 10, 2010

(54) NON-SLIP ABSORBENT PAD

(75) Inventors: Richard Beu, Yorba Linda, CA (US); Sayandro Versteylen, Rancho Cucamonga, CA (US)

(73) Assignee: Paper Pak Industries, Laverne, CA (US)

( * ) Notice: Subject to any disclaimer, the term of this patent is extended or adjusted under 35 U.S.C. 154(b) by 885 days.

(21) Appl. No.: 11/507,724

(22) Filed: Aug. 22, 2006

(65) Prior Publication Data

US 2007/0212968 A1 Sep. 13, 2007

Related U.S. Application Data

(60) Provisional application No. 60/741,919, filed on Dec. 2, 2005.

(51) Int. Cl.
*B32B 3/04* (2006.01)
*B65D 81/26* (2006.01)

(52) U.S. Cl. ..... 428/130; 206/204

(58) Field of Classification Search ..... 206/204; 442/101; 428/68, 76, 129, 130; 426/397, 426/398

See application file for complete search history.

(56) References Cited

U.S. PATENT DOCUMENTS

| | | | | |
|---|---|---|---|---|
| 3,738,359 | A | 6/1973 | Lindquist et al. | 128/132 D |
| 3,978,260 | A | 8/1976 | Dobbins et al. | 428/204 |
| 4,410,578 | A | 10/1983 | Miller | 428/117 |
| 4,865,855 | A | 9/1989 | Hansen et al. | 426/124 |
| 4,902,521 | A | 2/1990 | Rosenfeld | 426/112 |
| 5,055,332 | A | 10/1991 | Rhodes et al. | 428/74 |
| 5,320,895 | A | 6/1994 | Larsonneur et al. | 428/137 |
| 5,536,555 | A | 7/1996 | Zelazoski et al. | 428/138 |
| 5,560,945 | A | 10/1996 | Geddes et al. | 426/87 |
| 5,714,229 | A | 2/1998 | Ogden | 428/138 |
| 6,004,599 | A | 12/1999 | Bert et al. | 426/129 |
| 6,270,873 | B1 | 8/2001 | Darnett | 428/76 |
| 6,274,232 | B1 | 8/2001 | Otten et al. | 428/315.9 |
| 6,592,983 | B1 | 7/2003 | Carson et al. | 428/323 |
| 6,695,138 | B1 | 2/2004 | Colombo et al. | 206/204 |
| 6,749,910 | B1 | 6/2004 | Georgelos et al. | 428/34.9 |
| 6,790,468 | B1 | 9/2004 | Mize, Jr. et al. | 426/129 |
| 6,808,791 | B2 | 10/2004 | Curro et al. | 428/198 |
| 6,878,433 | B2 | 4/2005 | Curro et al. | 428/198 |
| 7,022,395 | B2 | 4/2006 | Ackerman et al. | 428/137 |
| 7,026,034 | B2 | 4/2006 | LeBoeuf et al. | 428/137 |
| 2002/0106429 | A1 | 8/2002 | Mudar et al. | 426/129 |
| 2003/0108646 | A1 | 6/2003 | O'Connor et al. | 426/392 |
| 2003/0232556 | A1 | 12/2003 | Toro et al. | 442/286 |
| 2004/0126513 | A1 | 7/2004 | Bekele et al. | 428/34.1 |
| 2004/0173491 | A1 | 9/2004 | Buelow et al. | 206/484 |
| 2004/0267223 | A1 | 12/2004 | Etchells | 605/385.01 |

OTHER PUBLICATIONS

Search Report from corresponding PCT Appln. PCT/US06/35851 dated Apr. 17, 2007.

*Primary Examiner*—Arti Singh-Pandey
(74) *Attorney, Agent, or Firm*—Ohlandt, Greeley, Ruggiero & Perle, L.L.P.

(57) ABSTRACT

There is provided a non-slip absorbent food pad with one or more non-slip surfaces. The one or more non-slip surfaces have a coefficient of friction (COF) suitable for preventing the packaged food product from slipping and/or sliding off of the non-slip absorbent food pad in various product display orientations. The present invention also provides for a method for making a non-slip absorbent food pad and method of using a non-slip absorbent pad in various packaging displays.

28 Claims, 2 Drawing Sheets

NON-SLIP ABSORBENT PAD

RELATED APPLICATION

The present application claims priority to U.S. Provisional Patent Application Ser. No. 60/741,919 filed on Dec. 2, 2005, which is incorporated by reference herein in its entirety.

BACKGROUND OF THE INVENTION

1. Field of the Invention

The present invention relates generally to absorbent pads. More particularly, the present invention relates to non-slip absorbent food pads.

2. Description of Related Art

An absorbent pad is used for a variety of purposes including food-packaging, medical absorbent, laboratory cleanup, transportation packaging and safety, and personal hygiene. One use of an absorbent pad in the food-packaging industry is for the absorption of fluids secreted from meat, poultry, seafood, and other food products, which may improve the safety, shelf life, and/or the aesthetics of the packaged food. Another component of food packaging is geared towards providing the consumer with an aesthetically appealing presentation at the display counter. To this end, packaged food is typically arranged and/or displayed in various configurations.

Absorbent pads are generally square or rectangular with straight edges. The absorbent core material is often a single layer of cellulose fluff, airlaid non-woven, or single or multiple layers of combined tissue. However, certain absorbent packaging designs and customer presentations require a unique and complex absorbent structure in order to meet their specific requirements. In the case of vertical and/or shingled presentations, there is a commercial need for absorbent pads that can eliminate the sliding of food products during such a display at the retail level, yet have sufficient design parameters to facilitate effective fluid absorption in order to help with a "dry package" presentation.

It is important, particularly in food packaging, that the presentation to the customer is such that the consumer is enticed to purchase the product. Therefore with a shingled display presentation, whether created by actual product being shingled or angled shelving display orientation, the packer is concerned with the location of the food product with respect to the tray and the visibility of purge within the package. Since a typical absorbent food pad has a surface with a Coefficient of Friction of only about 0.65 to about 1.0 (as measured on a Kayeness Coefficient of Friction tester), a problem that arises with such a display orientation is that the food product slides to the bottom of the tray, leaving an exposed section of the absorbent pad above the food product, causing an undesirable package presentation. Additionally, with the food product sliding to the bottom of the tray and the absorbent pad situated above the food, there is not sufficient absorption of the purge emanating from the food product.

Therefore, there remains a need in the art for a non-slip absorbent food pad that minimizes or eliminates food product slippage during a vertically oriented and/or shingled display presentation and that absorbs the purge emanating from the food product.

SUMMARY OF THE INVENTION

The present invention provides a non-slip absorbent food pad with one or more non-slip surfaces.

The present invention also provides such a non-slip absorbent pad that facilitates non-slippage of a food product while in various product display conditions and/or configurations.

The present invention further provides a non-slip absorbent food pad with sufficient absorbent capacity to facilitate a dry package presentation during various product display conditions or configurations.

The present invention still further provides such a non-slip absorbent food pad with multiple layers, portions, and/or zones to facilitate absorption capacity.

These and other advantages and benefits of the present invention are provided by a non-slip absorbent food pad with one or more non-slip surfaces. The one or more non-slip surfaces have a Coefficient of Friction (COF) suitable for preventing the packaged food product from slipping and/or sliding off of the non-slip absorbent food pad when positioned in various product display conditions and/or configurations. In addition, the non-slip surface adjacent to the base of the packaging prevents sliding of the non-slip absorbent pad itself once it is placed inside the packaging. The present invention also provides for a method for making a non-slip absorbent food pad, and a method for displaying packaged food using the non-slip absorbent pad in various display orientations.

DETAILED DESCRIPTION OF THE INVENTION

The present invention provides an absorbent food pad with one or more non-slip surfaces. As a result, various display orientations may be used to display packaged food without compromising the absorption of fluid emanating from the food contained in the package. The present invention also provides for methods of manufacturing an absorbent food pad with one or more non-slip surfaces and use of a non-slip absorbent food pad in various package displays and/or orientations.

Figure 1:
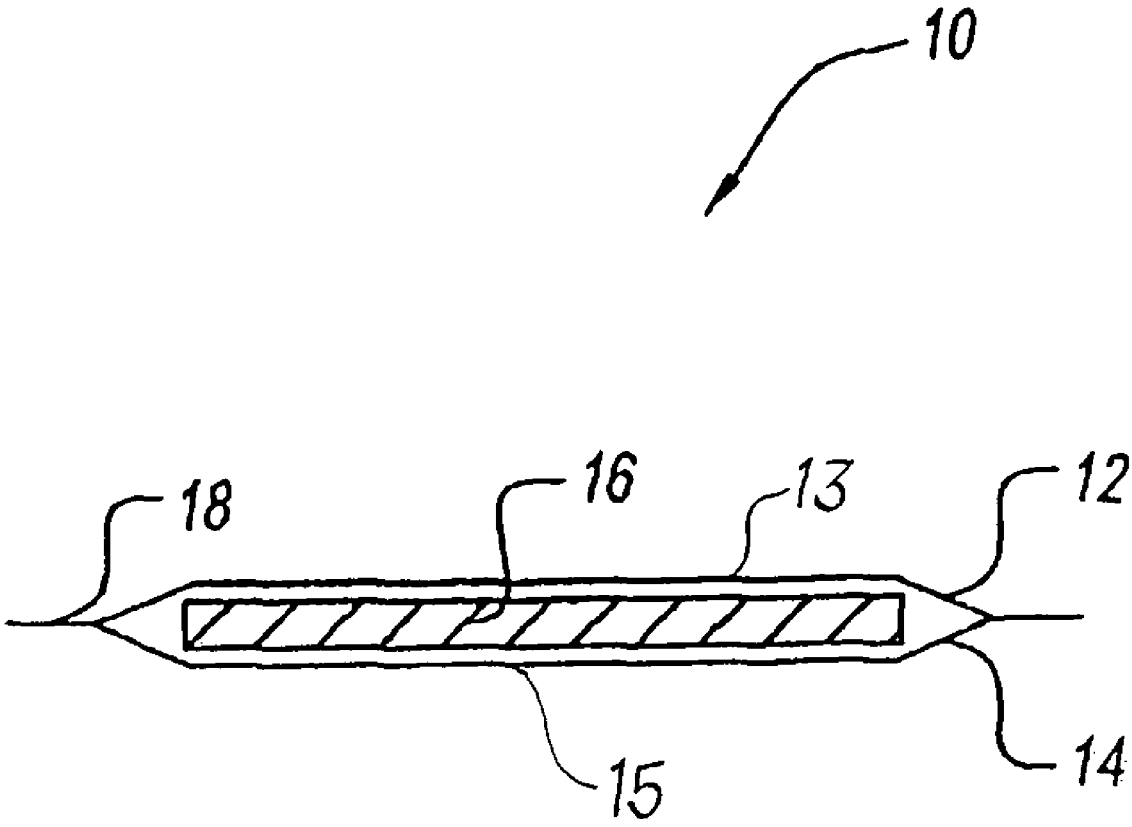
FIG. 1 is a side cut away view of a non-slip absorbent food pad according to the present invention.

Referring to the figures and, in particular, FIG. 1, there is provided non-slip absorbent food pad of the present invention, generally represented by reference number 10. The absorbent pad 10 has one or more top sheets 12 with a food-contacting surface 13, one or more bottom sheets 14 with a package-contacting surface 15, and an absorbent core 16 therebetween. Top sheets 12 and bottom sheets 14 are the outer layers of non-slip absorbent pad 10. Top sheets 12 and bottom sheets 14 may be bonded together around a periphery 18 of non-slip absorbent pad 10. Top sheets 12 and/or bottom sheets 14 can also be micro-perforated or slit. Any of the top sheets 12 or bottom sheets 14 can be liquid impervious, if desired.

Top sheets 12 are those sheets of the absorbent pad 10 that are located above (on top of) the absorbent core 16. The top sheets 12 may be comprised of a single sheet or multiple sheets. The outer surface of the outermost top sheet is the food-contacting surface 13.

The bottom sheets 14 are those sheets of the absorbent pad 10 that are located below (under) the absorbent core 16. The bottom sheets 14 may be comprised of a single sheet or multiple sheets. The outer surface of the outermost bottom sheet is the package-contacting surface 15.

Each sheet comprising of the one or more top sheets 12 and the one or more bottom sheets 14 of absorbent pad 10 can have between two and seven layers. However, a top sheet or bottom sheet made of a single layer is possible, if desired.

The multiple layers comprising any of the top sheets 12 or bottom sheets 14 can be simply adjacent to each other and not bonded except in areas that are heat-sealed. The multiple layers can also be adhered to each other without adhesive lamination, using static attraction and/or corona discharge. The multiple layers may be point bonded, pattern bonded, or intermittently bonded to each other using a bond area of about 5% to about 20% to provide sufficient attachment but maintain easy separation of layers. Point bonding and attachment of the multiple layers can provide perforation through the outer impermeable film layer to form a hole, where the perimeter of the hole fuses the outer and inner layers. This fusion around the perimeter of the hole provides strength, wicking, and added containment of the absorbent core. Point bonding of adjacent layers in the sheet in a controlled manner, using a bond area of about 5% to about 20%, allows for certain bonding areas with full penetration through the layers of the sheet, while providing simple mechanical attachment in other layers of the sheet.

Each of the layers comprising the top sheets 12 and/or bottom sheets 14 within the absorbent pad 10 can be made of a single material, or made of a combination of multiple materials. To achieve the non-slip properties of the absorbent pad 10 according to the present invention, it has been found that the material or materials used to make the layers should have a Coefficient of Friction (COF) suitable for substantially holding or retaining food on the absorbent pad 10 during various packaging displays and/or configurations including, but not limited to, shingled displays. The material or materials used for the package-contacting surface 15 of the bottom sheet 14 should have a Coefficient of Friction suitable to substantially hold or retain the absorbent pad in place within the packaging during various packaging displays or configurations, including, but not limited to, shingled displays.

Suitable materials for use to make the layers and/or sheets in the present invention include, but are not limited to, polyethylene, polypropylene, polyester, rayon, nylon, or any combinations thereof. In one preferred embodiment, the material is polyethylene.

A suitable Coefficient of Friction ("COF") (as measured on a Kayeness Model D-1055 Coefficient of Friction Tester) for the food-contacting surface of the top sheet 13 and the package-contacting surface of the bottom sheet 15 of the non-slip absorbent food pad include, but are not limited to, greater than about 1.4. In one embodiment, the coefficient of friction of the food-contacting surface 13 and/or the package-contacting surface 15 is greater than about 1.8. In another embodiment, the coefficient of friction of the food-contacting surface 13 and/or the package-contacting surface 15 is greater than about 2.1.

In one embodiment of the present invention the entire surface of either the top sheet 12 and/or bottom sheet 14 exhibit the desired COF. The desired COF may be imparted to the one or more top sheets 12 and/or bottom sheets 14 used in the present invention in any suitable manner.

In another embodiment of the present invention, one or more portions or zones on the surface of the top sheet 12 and/or the surface of the bottom sheet 14 have the desired COF. As a result, any desired non-slip configuration may be formed on any portion of the top sheet 12 and/or bottom sheet 14 of the non-slip absorbent food pad 10. The one or more portions and/or zones can be formed on the surfaces of the top sheets 12 and/or bottom sheets 14 by any suitable means including, but not limited to, surface printing, laminating different materials having varying COF, surface perforating, surface texturing, or any combinations thereof.

One of the features and benefits of a bottom sheet having a package-contacting surface 15 with the desired COF is that, in one embodiment of the invention, the absorbent pad 10 may be used in a product package without being attached to the bottom of the food tray with glue or other adhesive, thereby providing a food package that is less messy, and saving time and money.

The variety of non-slip portions or zones on the food-contacting surface 13 and package-contacting surface 15 allows the packaged product to be displayed in various configurations, such as a vertical or shingled configuration, without compromising the absorption capabilities and efficiency of the non-slip absorbent food pad.

The one or more layers that comprise each of the one or more top sheets 12 and/or bottom sheets 14 can be of any suitable thickness. Preferably the thickness of each layer is between about 0.00075 inches and about 0.003 inches. The one or more layers can be natural or pigmented in any color. Printing may also be done on any surface in any desired pattern.

The absorbent core 16 can be made of any material suitable for absorbing liquids, particularly food-product liquids. The absorbent core 16 is formed from about two to about ten layers of an absorbing material, but may be a single layer of an absorbing material. A preferred embodiment has an absorbent core formed from about eight to about ten layers of tissue. Examples of suitable absorbing materials include, but are not limited to, superabsorbent polymer (SAP), compressed SAP composite of superabsorbent polymer granules adhered with one or more binders and/or plasticizers, compressed composite containing short or microfiber materials, thermoplastic polymer fibers, thermoplastic polymer granules, cellulose powders, cellulose gels, an airlaid with superabsorbent, any fibrous or foam structure that has been coated or impregnated with a superabsorbent, absorbent structure having one or more starch or cellulose-based absorbents, absorbent structure containing superabsorbent material formed and/or crosslinked in-situ, tissue, paper, or any combinations thereof. Superabsorbent material can be used in various forms. Examples of suitable superabsorbent material forms include, but are not limited to, granular, fiber, liquid, superabsorbent hot melts, or any combinations thereof. Compressed composites of short and microfiber (from about 0.1 inches to about 0.3 inches in length) materials having between about 3% and about 25% short or micro-fiber content have been shown to strengthen the core for high speed processing but retain the desired properties of low cost and high speed absorption and wicking.

The non-slip absorbent food pads 10 of the present invention can be manufactured in any shape or combination of shapes using straight, curved or a combination of straight and curved dimensions. Examples of possible shapes include, but are not limited to, round, oblong, rectangular, extended rectangular, trapezoidal, triangular, donut-shape, cone and/or rod, and repeating arrangements of shapes or geometries. The absorbent pad 10 itself, as well as the absorbent core 16, can have any shape or combinations of shapes or configurations including, for example, a shape that corresponds to the packaging shape and/or the food being packaged.

Further examples of shaped absorbent pads, absorbent pads with absorbent cores having various configurations, and the manufacture thereof, that are suitable for use in the present invention, are described in a co-pending patent application bearing Ser. No. 10/802,254, entitled "Shaped Absorbent Pads," the entire disclosure of which is hereby incorporated by reference herein.

The size of the non-slip absorbent food pad 10 can range from very small to very large. Typical sizes range from approximate dimensions of about 1 inch wide and about 1 inch long up to about 24 inches wide and about 42 inches long. In one embodiment, the dimensions are about 5 inches wide and about 7 inches long. In another embodiment, the dimensions are about 6 inches wide and about 9 inches long. It should be understood that the dimensions of the non-slip absorbent food pad 10 may be modified and selected for reasons including, but not limited to, packaging dimensions and the type of food to be packaged.

The non-slip absorbent food pads 10 according to the present invention may also include one or more active components in either the top sheets 12, bottom sheets 14, and/or absorbent core 16, to impart value-added features including, but not limited to, microbial control, sanitization, and atmospheric modification such as oxygen scavenging, $CO_2$ emission, or ethylene emission. Suitable active components include, but are not limited to, one or more antimicrobial agents, sanitizing agents, oxygen scavengers, $CO_2$ emitters, ethylene scavengers, surface-active agents, and other active components that are biological or inert in nature, or any combinations thereof.

Further examples of actives and related active systems that may be used in the non-slip absorbent food pad 10 are described in co-pending patent application bearing Ser. No. 11/335,373 entitled "Food Preservation Systems," the disclosure of which is incorporated in its entirety by reference herein.

The one or more top sheets 12 and bottom sheets 14 of the non-slip absorbent food pad 10 can be sealed together at the edges or periphery 18 of the absorbent pad, or at various locations throughout the pad. It has been found that, to prevent seam failure that is prevalent in conventional absorbent pads due to the swelling of the absorbent core, proper sealing of the top sheet to the bottom sheet can be obtained through adhesive sealing, thermal sealing, pressure sealing, and/or ultrasonic sealing. These methods provide a solid bond capable of resisting bursting. An embossing, knurling, or point-bonding pattern can be used for even stronger and more flexible bonding than simple flat bonding.

One or more of the outer layers comprising the top sheets 12 or bottom sheets 14 of the absorbent food pad 10 may be perforated to allow for fluid transport across the layers. Suitable methods of perforating the outer layers include, but are not limited to, cold needle perforation, hot needle perforation, ultrasonic pattern roll, and anvil process.

The non-slip absorbent food pads 10 can be perforated in any desired pattern. Perforations that are intentionally random in pattern, such that the holes do not line up substantially in any direction, are preferred where prevention of layer tearing is desired. The layers can be perforated in such a manner that the area to be sealed is left without perforations, target zones for controlled fluid uptake are created, perforations of different shapes and sizes are formed, or any combinations of the foregoing. The perforations can be large window-like holes that directly expose the inner components of the pad, such as an absorbent material, active component, or fluid acquisition/transfer/transport layer. Within the same pad, perforations can vary in pattern and size. Using small holes or micro-perforations (for example smaller than about 0.01 inches) near the center of the pad where the food will come into contact with the pad can help minimize the desiccation effect, while larger holes near the perimeter will facilitate greater absorption of fluid run-off into the absorbent core.

The non-slip absorbent food pads 10 may also employ static charges to adhere various sheets and/or layers of the absorbent pad together. Using static electricity, typically involving emission of negative ions, the shaped absorbent core or other internal components can be adhered electrostatically to the top sheets, bottom sheets, or to other layers of film, non-woven, or paper that may be used in the absorbent pad 10. This electrostatic adhesion usually occurs prior to the heat-sealing phase. The need for adhesive may thus be eliminated.

The sheets and/or layers of the non-slip absorbent food pads 10 may be corona treated. Corona treatment of film, non-woven, and coated or treated paper surfaces is generally used to promote improved ink anchorage in printing. It has been found that corona treatment of the inside surfaces of layers of film, non-woven, and paper n the absorbent pads 10 without adhesives improves adhesion during the heat sealing stage. Not being limited by this theory, it is believed that corona treatment reduces the surface tension.

The non-slip absorbent food pads 10 may be constructed by any method appropriate to result in the unique features of these absorbent pads. In general, raw materials are brought to the processing line in rolls. The materials are converted into the absorbent pads 10 of the present invention. Waste material, such as scrap matrix, are sent either directly to a compactor or recycled depending on the material content. Finished pads are processed in one or more of several ways including: cut into individual pieces and packaged in bulk, connected together with perforations and wound onto a roll or spool for downstream processing, connected together with perforations and placed into a bin or carton for downstream processing, or placed into a tube or magazine for later insertion into a high-speed placement device.

EXAMPLE

A non-slip absorbent food pad is constructed with a top sheet of polyethylene having a Coefficient of Friction (COF) greater than about 1.8. A bottom sheet is selected from a non-woven material. The absorbent core is formed from about 8 to about 10 layers of tissue. The absorbent core is positioned between the top sheets and the bottom sheets, and the top sheets and bottom sheets are sealed around their periphery with a hot melt adhesive. The resulting non-slip absorbent food pad has a width from about 5 inches to about 7 inches and a length from about 7 inches to about 9 inches.

Figure 2:
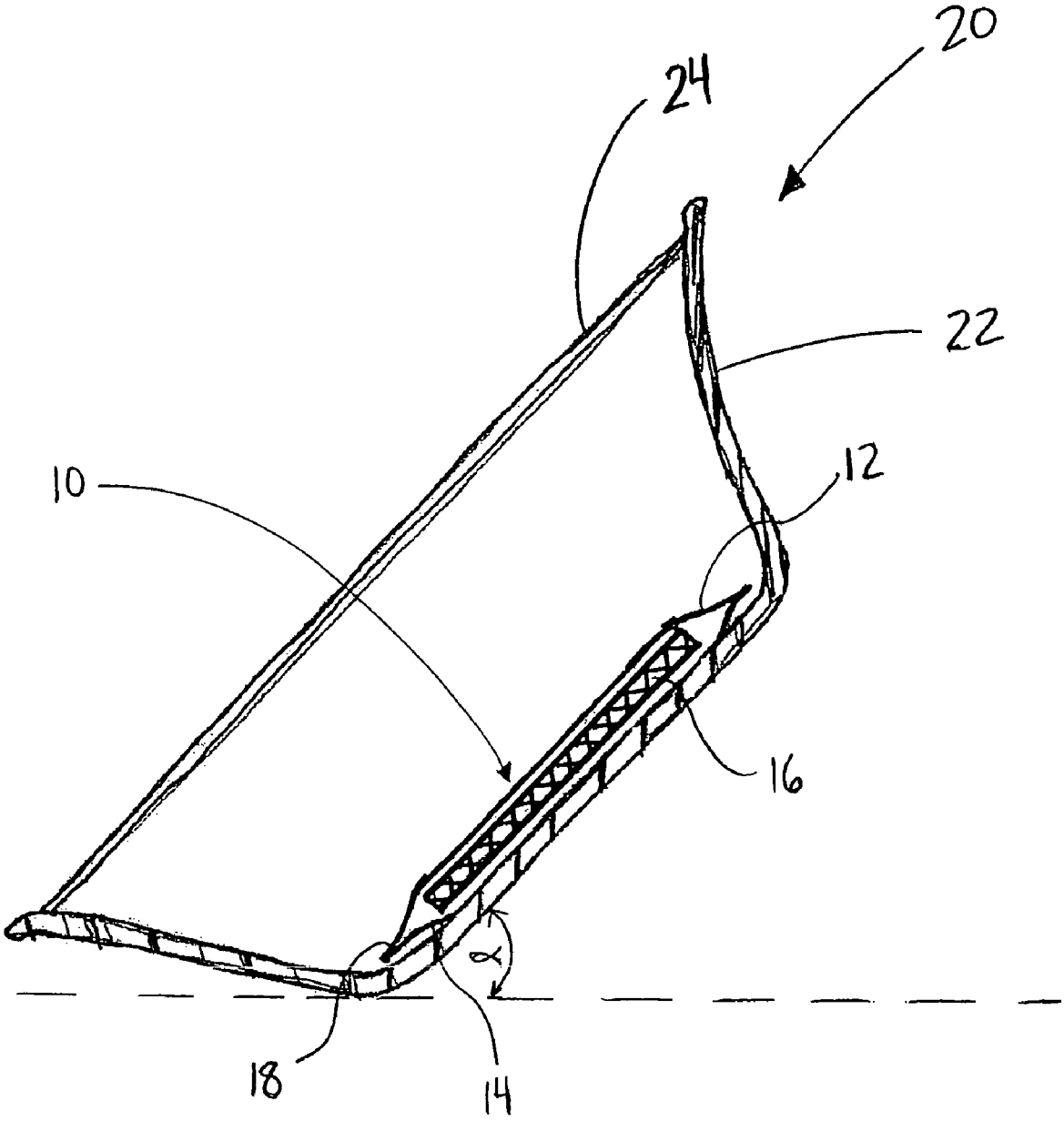
FIG. 2 is side cut away view of a food package oriented in a shingled display position with the non-slip absorbent food pad according to the present invention.

The non-slip absorbent pads 10 are particularly useful in applications where it is desired to have a shingled display. Referring to FIG. 2, in one embodiment, the non-slip absorbent food pad 10 is placed in a package 20 that is oriented in a shingled display configuration. Package 20 has a container portion 22 and a seal 24. When container 20 is displayed in a shingled orientation, the angle $\alpha$ may be between about 20° to about 60°. Preferably, the angle $\alpha$ may be between about 30° and about 60°. In a more preferred embodiment, the angle $\alpha$ is about 30°.

It should be understood that the foregoing description is only illustrative of the present invention. Various alternatives and modifications can be devised by those skilled in the art without departing from the invention. Accordingly, the present invention is intended to embrace all such alternatives, modifications and variances.

We claim:

1. A non-slip absorbent food pad comprising:
one or more top sheets;
one or more bottom sheets; and
an absorbent core disposed between said one or more top sheets and said one or more bottom sheets,
wherein said one or more top sheets has a food-contacting surface with a coefficient of friction of at least about 1.4, said food-contacting surface holds food in place on the non-slip absorbent food pad when the food is in a shingled display.

2. The non-slip absorbent food pad of claim 1, wherein said food-contacting surface has a coefficient of friction of at least about 1.8.

3. The non-slip absorbent food pad of claim 1, wherein said food-contacting surface has a coefficient of friction of at least about 2.1.

4. The non-slip absorbent food pad of claim 1, wherein said one or more bottom sheets has a package-contacting surface with a coefficient of friction of at least about 1.4.

5. The non-slip absorbent food pad of claim 1, wherein said one or more top sheets and/or said one or more bottom sheets comprises between about one to about seven layers of a material.

6. The non-slip absorbent food pad of claim 5, wherein said material is selected from the group consisting of polyethylene, polypropylene, polyester, rayon, nylon, and any combinations thereof.

7. The non-slip absorbent food pad of claim 5, wherein said material is polyethylene.

8. The non-slip absorbent food pad of claim 5, wherein said about one to about seven layers of a material each have a thickness of about 0.00075 inches to about 0.003 inches.

9. The non-slip absorbent food pad of claim 1, wherein said food-contacting surface has an entire area that has said coefficient of friction of at least about 1.4.

10. The non-slip absorbent food pad of claim 1, wherein said food-contacting surface has one or more zones, wherein said one or more zones have a coefficient of friction of at least about 1.4.

11. The non-slip absorbent food pad of claim 1, wherein said absorbent core comprises a material selected from the group consisting of superabsorbent polymer (SAP), compressed SAP composite of superabsorbent polymer granules adhered with one or more binders and/or plasticizers, compressed composite containing a percentage of short or microfiber materials, thermoplastic polymer fibers, thermoplastic polymer granules, cellulose powders, cellulose gels, airlaid, airlaid with superabsorbent, fibrous structure that has been coated or impregnated with a superabsorbent, foam structure that has been coated or impregnated with a superabsorbent, absorbent structure having one or more starch based absorbents, absorbent structure having one or more cellulose-based absorbents, absorbent structure containing superabsorbent material formed and/or crosslinked in-situ, tissue, paper, and any combinations thereof.

12. The non-slip absorbent food pad of claim 1, wherein said non-slip absorbent food pad is in a shape selected from the group consisting of round, oblong, rectangular, extended rectangular, trapezoidal, triangular, donut-shape, cone, rod, and any combinations thereof.

13. The non-slip absorbent food pad of claim 1, wherein said non-slip absorbent food pad has a width between about 1 inch to about 24 inches and a length between about 1 inch to about 42 inches.

14. The non-slip absorbent food pad of claim 1, further comprising one or more active components, said one or more active components in said one or more top sheets, said one or more bottom sheets, said absorbent core, or any combinations thereof.

15. The non-slip absorbent food pad of claim 14, wherein said one or more active components are selected from the group consisting of antimicrobial agents, sanitizing agents, oxygen scavengers, $CO_2$ emitters, ethylene scavengers, surface-active agents, and any combinations thereof.

16. The non-slip absorbent food pad of claim 1, wherein said one or more top sheets and/or said one or more bottom sheets are perforated.

17. A non-slip absorbent food pad comprising:
one or more top sheets having a coefficient of friction greater than about 1.8;
one or more bottom sheets; and
an absorbent core disposed between said one or more top sheets and said one or more bottom sheets;
wherein said food-contacting surface holds food in place on the non-slip absorbent food pad when the food is in a shingled display.

18. The non-slip absorbent food pad of claim 17, wherein said one or more top sheets are polyethylene.

19. The non-slip absorbent food pad of claim 17, wherein said absorbent core comprises about 8 to about 10 layers of tissue.

20. The non-slip absorbent food pad of claim 17, wherein said non-slip absorbent food pad has a width of about 5 inches to about 7 inches and a length of about 7 inches to about 9 inches.

21. A method of providing a packaged food in a shingled display comprising the steps of:
providing a non-slip absorbent food pad;
disposing said non-slip absorbent food pad in a package;
placing one or more food items on said non-slip absorbent food pad in said package resulting in a packaged food; and
orienting said packaged food in a shingled display configuration.

22. The method of claim 21, wherein said shingled display configuration is oriented at an angle between about 20° to about 60°.

23. The method of claim 21, wherein said shingled display configuration is oriented at an angle between about 30° and about 60°.

24. The method of claim 21, wherein said shingled display configuration is oriented at an angle of about 30°.

25. The method of claim 21, wherein said non-slip absorbent food pad comprises one or more top sheets having a food-contacting surface with a coefficient of friction of at least about 1.4.

26. The method of claim 21, wherein said non-slip absorbent food pad comprises one or more top sheets having a food-contacting surface with a coefficient of friction of at least about 1.8.

27. The method of claim 21, wherein said non-slip absorbent food pad comprises one or more top sheets having a food-contacting surface with a coefficient of friction of at least about 2.1.

28. The method of claim 21, wherein said non-slip absorbent food pad comprises one or more bottom sheets having a package-contacting surface with a coefficient of friction of at least about 1.4.

* * * * *